US010513911B2

(12) United States Patent
Vu et al.

(10) Patent No.: US 10,513,911 B2
(45) Date of Patent: Dec. 24, 2019

(54) ONE TRIP DIVERTER PLACEMENT, TREATMENT AND BOTTOM HOLE ASSEMBLY REMOVAL WITH DIVERTER

(71) Applicant: BAKER HUGHES, A GE COMPANY, LLC, Houston, TX (US)

(72) Inventors: John Vu, Houston, TX (US); Bryan P. Pendleton, Cypress, TX (US); Basil J. Palakapilly, Sugar Land, TX (US); Deshuttaney Mosley, Houston, TX (US); Christopher Cook, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 677 days.

(21) Appl. No.: 15/232,071

(22) Filed: Aug. 9, 2016

(65) Prior Publication Data

US 2018/0045021 A1 Feb. 15, 2018

(51) Int. Cl.
*E21B 41/00* (2006.01)
*E21B 33/12* (2006.01)

(52) U.S. Cl.
CPC ..... *E21B 41/0042* (2013.01); *E21B 33/12* (2013.01); *E21B 41/0035* (2013.01)

(58) Field of Classification Search
CPC ..... E21B 33/12; E21B 41/002; E21B 41/0035
See application file for complete search history.

(56) References Cited

U.S. PATENT DOCUMENTS

| | | | | |
|---|---|---|---|---|
| 4,993,493 | A * | 2/1991 | Arnold | E21B 23/02 166/117 |
| 5,564,503 | A | 10/1996 | Longbottom et al. | |
| 6,041,860 | A | 3/2000 | Nazzal et al. | |
| 6,050,334 | A | 4/2000 | McGarian et al. | |
| 6,125,937 | A * | 10/2000 | Longbottom | E21B 23/002 166/117.5 |
| 6,158,513 | A | 12/2000 | Nistor et al. | |
| 7,905,279 | B2 | 3/2011 | Hart et al. | |
| 7,997,336 | B2 | 8/2011 | Sokol et al. | |
| 8,590,608 | B2 | 11/2013 | Linn et al. | |
| 8,904,617 | B2 | 12/2014 | Carmody et al. | |
| 2010/0078178 | A1* | 4/2010 | Watson | E21B 17/06 166/380 |
| 2018/0274300 | A1* | 9/2018 | Vemuri | E21B 7/061 |

FOREIGN PATENT DOCUMENTS

WO 2015109147 A1 7/2015

* cited by examiner

*Primary Examiner* — Robert E Fuller
*Assistant Examiner* — Lamia Quaim
(74) *Attorney, Agent, or Firm* — Shawn Hunter

(57) ABSTRACT

A bottom hole assembly supports a diverter for landing in an existing multilateral junction. Once landed set down weight allows the BHA to progress through the diverter opening into a main bore, for example. A protective sleeve for the seal assembly lands on a shoulder above the targeted seal bore. Further advancing of the BHA moves the seal assembly out of the protective sleeve that has landed on the shoulder by the polished bore. Once the seals are in position in the bore a treatment can be accomplished. On picking up the seal assembly retracts into the protective sleeve and the BHA engages the diverter to bring the BHA and the diverter out of the borehole at the same time.

18 Claims, 4 Drawing Sheets

ONE TRIP DIVERTER PLACEMENT, TREATMENT AND BOTTOM HOLE ASSEMBLY REMOVAL WITH DIVERTER

FIELD OF THE INVENTION

The field of the invention is one trip systems for delivery of a diverter and a bottom hole assembly for treatment where the bottom hole assembly is positioned with the diverter landed in a multilateral junction and seals contacting a seal bore for the treatment followed by removal of the bottom hole assembly with the diverter.

BACKGROUND OF THE INVENTION

For more than the past decade, multilateral wells have become increasingly popular. These wells increase the accessibility to formation reserves in oil and gas production fields. A multilateral well is constructed by drilling a main well bore and then drilling branch well bores, or lateral well bores, off of the main well bore into different producing regions of the reservoir. Once drilled, the multilateral well resembles a branch of a fern with lateral branches directed off of the main well bore or stem. These multilateral branch well bores are known to be drilled in both vertical wells and horizontal wells. The primary advantage of multilateral well construction is the ability to drain a much larger portion of the hydrocarbon bearing reservoir with a single well bore from the surface.

Drilling the lateral "legs", or branch well bores, off of the main well bore commonly requires a device called a whipstock. A whipstock is a long wedge shaped tool that attaches to the well casing and forces or directs the drill string away from the centerline of the main well bore in order to create the lateral well bore. Prior to drilling the lateral or branch well bore, the whipstock is run into the hole and locked in place in the main well bore. The whipstock has an angled face oriented to direct the drill bit in a specific direction off the main well bore where one desires to form the lateral or branch well bore. First, the whipstock directs a special mill to create a "window" or "milled casing window" through the side of the casing of the main well bore. The next step is to go back with a drill bit to complete the lateral or branch well bore through the window. After drilling the lateral well bore, the whipstock is retrieved from the well leaving the main well bore and lateral well bore(s) open.

If re-entry to the lateral well bore is required, the whipstock is typically located in place in the main well bore, and used therein, using an "orienting collar" positioned in the original casing string. The orienting collar ensures that the whipstock will relocate at the exact place and orientation on subsequent runs.

Multiple lateral or branch well bores may be drilled using the same method, each requiring an orienting collar which is positioned in the main well bore so that the whipstock can be positioned and oriented where each lateral well bore is to be drilled. Prior to running the casing string, the orienting collars must be "timed", that is, properly circumferentially oriented within the main well bore, so that the lateral well bores are drilled in the preferred directions relative to each other.

After the lateral well bore(s) are drilled, the multilateral well will have a main well bore and lateral(s) or branch well bore(s) drilled off of the main well bore. There will be a need to reenter each of the well bores at a later date in order to provide "intervention" services such as fracturing, stimulation or cleanout which require mechanical and pressure integrity within each well bore. Consider, for example, the process involved in order to fracture stimulate each of the bores of a multilateral well, which is a common procedure to enhance production. The workstring is first positioned into the main well bore to fracture the formation, followed by repositioning the workstring into each of the lateral well bores for fracturing each respective formation. With current technology, in order to access each respective lateral well bore, the operator must reinstall the whipstock in the predetermined position in the main well bore. When the operator wants to enter a different lateral well bore, the operator must completely pull the workstring out of the well, and reinstall the whipstock in the new position and rerun the workstring. In fact, each time the operator wants to enter a lateral well bore or the main well bore, the workstring must be removed, the whipstock must be repositioned and the workstring must be redeployed. This adds up to a considerable amount of rig time in performing these operations. In addition, companies that provide support services, such as pump companies, are standing idle waiting for these repositioning operations to complete. During this time, the operator is required to pay the ancillary service companies to stand by, or risk losing their services to another operator resulting in considerable delays in the project. As such, the well operator bears a considerable cost in order to reap the benefits of multilateral completions.

More recently a system has been proposed that allows movement sequentially into different laterals or back into the main bore using alignment collars and locating keys at each junction that were used to orient whipstocks on prior multi-trip systems. The reconfiguration involved string rotation which in deviated boreholes creates uncertainties. Passage through such equipment also posed risks to the seals in the seal assembly between movements from one seal bore to another. This method is illustrated in U.S. Pat. No. 8,590,608.

The present invention seeks to simplify the past multi-trip operations with a simple bottom hole assembly (BHA) that features a support for a diverter to land the diverter in a multilateral junction. Once the diverter is landed the inner string advances through the diverter to the intended seal bore with the seals protected by a sleeve. The sleeve lands above the seal bore and the BHA is further advanced to expose the seals into the adjacent seal bore for well treatment. After the treatment the BHA is pulled out to again allow the seals to be protected by the sleeve as the BHA passes through the diverter. The assembly picks up the diverter on the trip out of the hole for complete removal without rotation. These and other aspects of the present invention will be more apparent to those skilled in the art from a review of the description of the preferred embodiment and the associated drawings while recognizing that the full scope of the invention is to be determined from the appended claims.

SUMMARY OF THE INVENTION

A bottom hole assembly supports a diverter for landing in an existing multilateral junction. Once landed set down weight allows the BHA and protected seal assembly to progress through the diverter opening into a main bore, for example. A protective sleeve for the seal assembly lands on a shoulder above the targeted seal bore. Further advancing of the BHA moves the seal assembly out of the protective sleeve that has landed on the shoulder and engage in the polished bore. Once the seals are positioned in the bore a treatment can be accomplished. On picking up, the seal assembly retracts into the protective sleeve and the BHA engages the diverter on the trip back to bring the BHA and the diverter out of the borehole at the same time.

DETAILED DESCRIPTION OF THE PREFERRED EMBODIMENT

Figure 1:
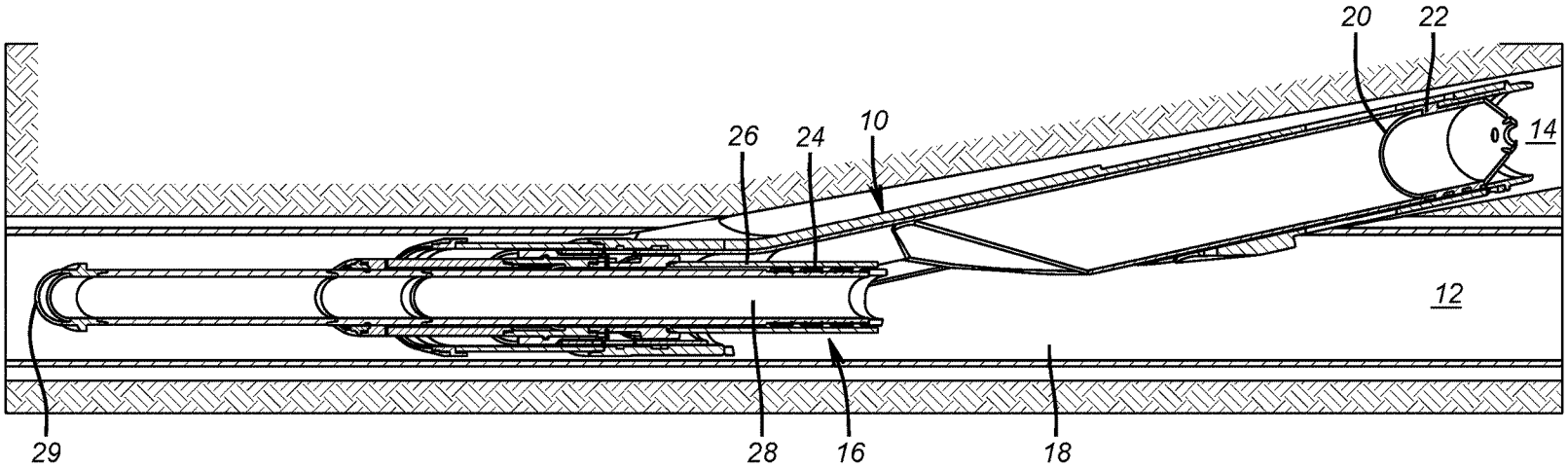
FIG. 1 is a section view of the BHA with diverter coming into the junction.
Figure 2:
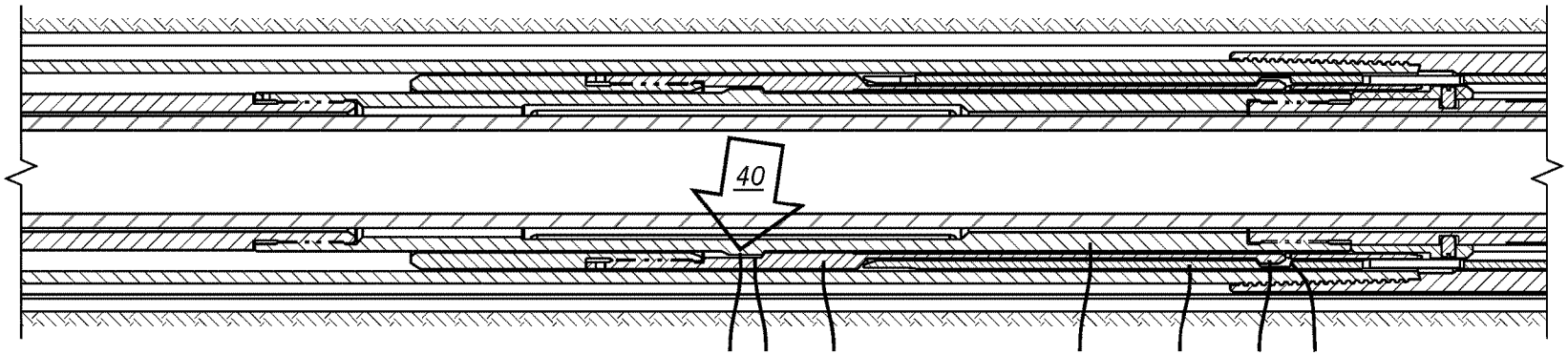
FIG. 2 is a detail of FIG. 1 showing weight set down to release the seal protector from the latch collet.
Figure 3:
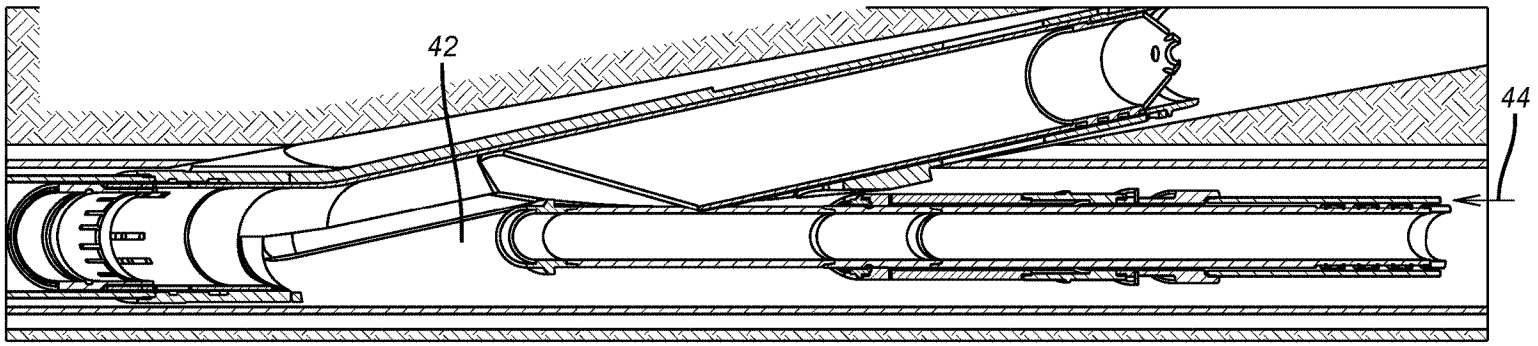
FIG. 3 is the view of FIG. 2 with the BHA advanced through the diverter opening.
Figure 4:
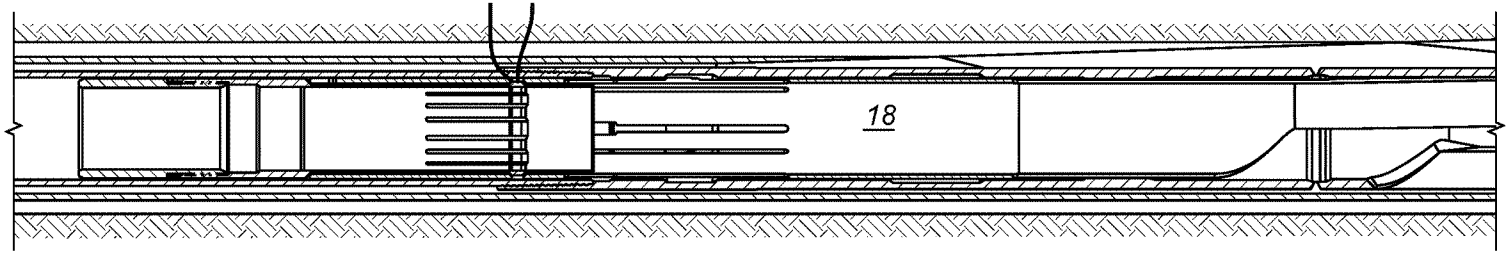
FIG. 4 is the view of FIG. 3 with the latch collet still engaged to the diverter but not locked to the diverter and the seal protector advanced to a no go.

FIG. 1 shows an existing multilateral junction 10 connecting a main bore 12 and a lateral 14. The BHA 16 includes a diverter 18 having a shoulder 20 that engages a support surface 22 in the junction 10 to provide a signal to surface personnel that the diverter 18 has been fully advanced into the junction 10. The BHA 16 comprises a seal assembly 24 covered by a seal protector sleeve 26. The seal assembly 24 is mounted to a mandrel 28 disposed at the lower end of a running string 29.

Figure 5:
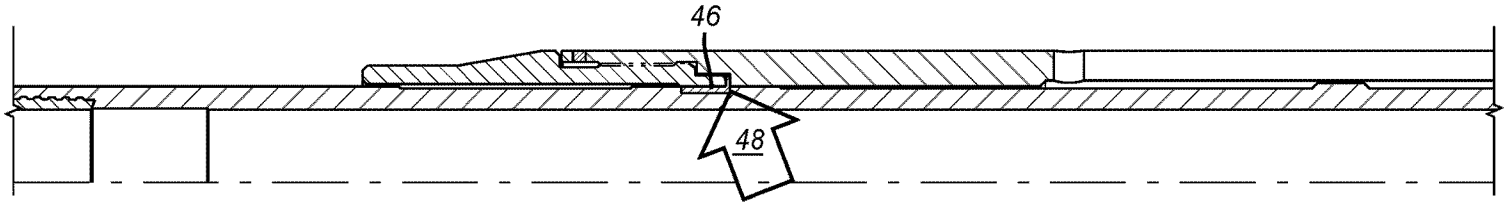
FIG. 5 shows weight set on the seal protector to break a retainer so that the seal assembly can advance into a seal bore.
Figure 6:
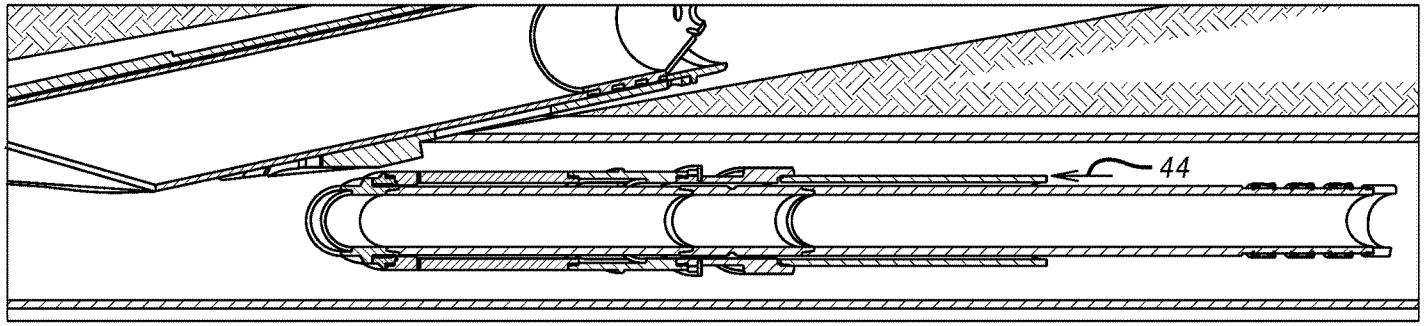
FIG. 6 shows the seal assembly extended from the seal protector for contact into the surrounding seal bore that is not shown.
Figure 7:
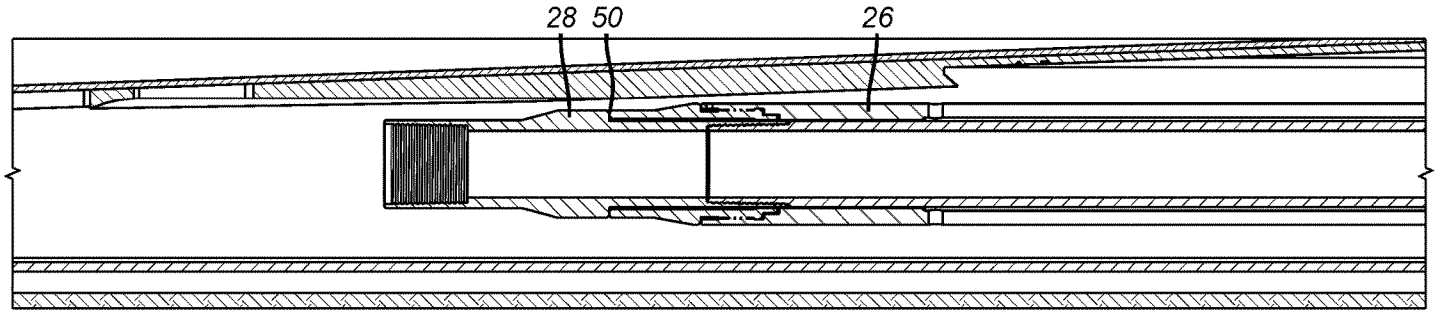
FIG. 7 shows the work string landing on the seal protector—thereby limiting the downward stroke of the seals and providing a shoulder to set down weight while treatment.
Figure 8:
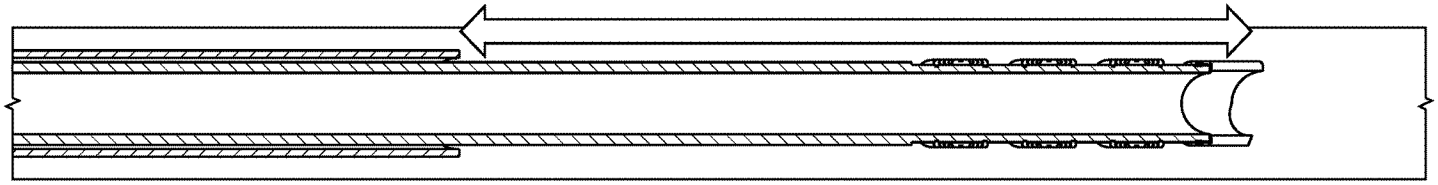
FIG. 8 is an enlarged view of the seal assembly extended from the protector into the seal bore that is not shown.
Figure 9:
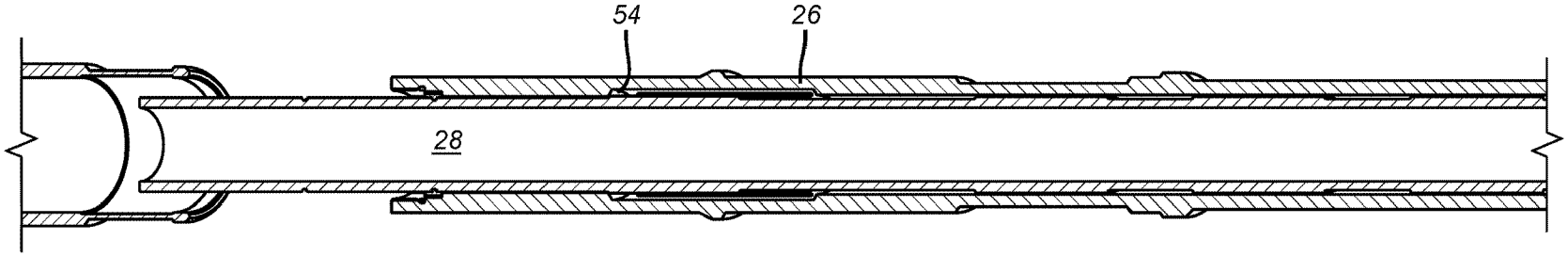
FIG. 9 shows removal of the BHA by engaging the seal protector after the seal assembly is retracted into the seal protector.

Protector sleeve 26 has a series of exterior collets 30 sprung into groove 32 on latch collet 34. Latch collet 34 has a series of collet heads 36 trapped in a groove 38 by the protector sleeve 26. Arrow 40 points to the collet 30 that is radially inwardly displaced when weight of about 25,000 pounds is set down on running string 29 with the diverter 18 landed on support surface 22. With the collet 30 retracted, the string 29 is lowered through an opening 42 in the diverter 18 and advanced into the main bore 12. As sleeve 26 advances the collet heads 36 remain in groove 38 but are no longer trapped by sleeve 26. Heads 36 remain in groove 38 because the position of the diverter 18 is fixed as described above. As the string 29 advances the mandrel 28 through the opening 42 in the diverter 18 the sleeve 26 bottoms just above a seal bore that is not shown in the main bore 12 as schematically represented by arrow 44. Further setting down weight in the order of another 30,000 pounds breaks a shear ring 46 pointed out by arrow 48 in FIG. 5. FIG. 6 shows further advancement of the string 29 until mandrel 28 shoulders at 50 to sleeve 26 which is already shouldered at the polished bore receptacle shown schematically as 44. As shown in FIG. 8 the seal assembly 24 can advance into the seal bore that is not shown so that a pressurized service can be performed in the main bore 12.

Figure 10:
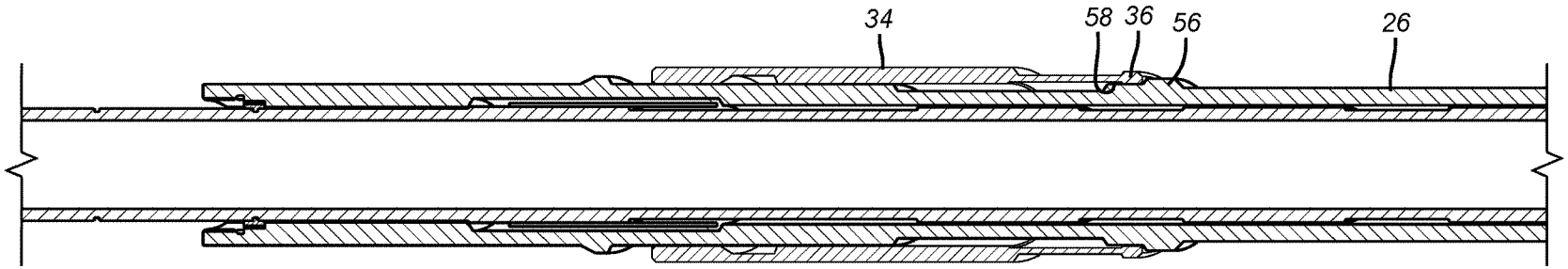
FIG. 10 shows the diverter latch collet again supported so that the diverter can be removed.

After the pressure treatment is completed the string 29 is picked up and this retracts the seal assembly 24 into sleeve 26 until a shoulder 54 on the mandrel 28 engages sleeve 26 for tandem movement toward opening 42 of the diverter 18. The latch collet 34 has its collet heads 36 again supported into groove 38 by surface 58 of the sleeve 26. Surface 56 of the sleeve 26 at this time engages the collet heads 36 so that an upward force on the string 29 also brings up the diverter 18 out of the multilateral junction 10 as shown in FIG. 10.

Those skilled in the art will appreciate that the diverter can be configured to direct the mandrel 28 into the lateral instead of the main bore as shown. There is no rotation needed to place the seal assembly inside a seal bore. The seal assembly is run in protected by a surrounding sleeve and then only extended from the protective sleeve when located adjacent the seal bore to be used for the well treatment. The components seamlessly release and re-latch on running in and on pulling from the hole. Several trips are saved compared to the previous multi-trip procedure initially described above. Ostensibly, more than one lateral can be accessed with the diverter 18 using multiple alignment subs at each junction 10 of a type known in the art.

The above description is illustrative of the preferred embodiment and many modifications may be made by those skilled in the art without departing from the invention whose scope is to be determined from the literal and equivalent scope of the claims below:

We claim:

1. A one trip multilateral well treatment method, comprising:

supporting a diverter with a bottom hole assembly (BHA) on a multilateral junction;

providing a seal assembly selectively covered with a protective sleeve;

advancing said BHA with a mandrel through said diverter to a seal bore;

extending said seal assembly from said protective sleeve and into the seal bore; releasing the diverter from the BHA as the seal assembly is extended from said protective sleeve and into the seal bore;

performing a pressure treatment using said seal assembly in said seal bore;

removing said BHA and said diverter in a single trip.

2. The method of claim 1, comprising:

inserting or removing said diverter from said multilateral junction without rotation of a running string supporting said BHA and diverter.

3. The method of claim 1, comprising:

landing said protective sleeve on a seal bore no go;

setting down weight to extend said seal assembly from said protective sleeve.

4. The method of claim 1, comprising:

releasably latching said protective sleeve to said diverter for running in.

5. The method of claim 1, comprising:

breaking a breakable member to allow said seal assembly to extend past said protective sleeve and into the seal bore.

6. The method of claim 1, comprising:

securing said diverter to said protective sleeve with a releasable collet.

7. The method of claim 6, comprising:

releasing a hold of said protective sleeve on said diverter with said releasable collet after said diverter is supported in said multilateral junction and said protective sleeve moves relative to said diverter and away from said collet.

8. The method of claim 7, comprising:

re-securing said collet to said diverter with said protective sleeve when pulling said protective sleeve back through said diverter.

9. The method of claim 3, comprising:

landing said BHA on said protective sleeve on said seal bore no go;

positioning said seal assembly in a predetermined location in said seal bore by landing.

10. The method of claim 9, comprising:

retracting said seal assembly into said protective sleeve;

engaging said protective sleeve with said BHA when removing said BHA.

11. The method of claim 10, comprising:

engaging a releasable collet associated with said diverter with said protective sleeve for removal of said diverter with said BHA.

12. A bottom hole assembly (BHA) for borehole access through a multilateral junction, comprising:

a mandrel releasably supporting a diverter with a seal assembly protective sleeve mounted to said mandrel, said protective sleeve selectively removable from said seal assembly for entry of said seal assembly into a seal bore after said protective sleeve passes through said diverter thereby releasing said diverter from said mandrel.

13. The assembly of claim 12, wherein:

said protective sleeve is selectively secured to said diverter with a first collet assembly.

14. The assembly of claim 13, wherein:

said protective sleeve releases from said collet assembly with set down weight flexing a second collet assembly.

15. The assembly of claim 14, wherein:

said protective sleeve no goes adjacent said seal bore, whereupon setting down weight breaks a breakable member allowing said mandrel with said seal assembly to move into said seal bore.

16. The assembly of claim 15, wherein:

said mandrel no goes against said protective sleeve when extending said seal assembly into said seal bore.

17. The assembly of claim 16, wherein:

said mandrel picks up said protective sleeve when pulling said seal assembly out of said seal bore.

18. The assembly of claim 17, wherein:

said protective sleeve picks up said first collet assembly when passing through said diverter to re-engage said diverter when said mandrel is moved out of a borehole.

* * * * *